US005997246A

United States Patent [19]

Humbad

[11] Patent Number: 5,997,246

[45] Date of Patent: Dec. 7, 1999

[54] HOUSING FOR A CENTRIFUGAL BLOWER

[75] Inventor: Niranjan Gendilal Humbad, Novi, Mich.

[73] Assignee: Ford Motor Company, Dearborn, Mich.

[21] Appl. No.: 09/053,977

[22] Filed: Apr. 2, 1998

[51] Int. Cl.[6] ..... F01D 5/10

[52] U.S. Cl. ..... 415/119; 415/184; 415/186; 415/203; 415/204; 415/206; 415/208.1; 415/211.1; 415/211.2; 415/214.1

[58] Field of Search ..... 415/119, 184, 415/186, 203, 204, 206, 208.1, 211.1, 211.2, 214.1

[56] References Cited

U.S. PATENT DOCUMENTS

| | | | |
|---|---|---|---|
| 3,684,396 | 8/1972 | Ball et al. | 415/53 |
| 3,687,360 | 8/1972 | Prew et al. | 233/46 |
| 4,078,870 | 3/1978 | Keller et al. | 415/54 |
| 5,141,397 | 8/1992 | Sullivan | 415/206 |
| 5,399,068 | 3/1995 | Park | 415/204 |
| 5,601,400 | 2/1997 | Kondo et al. | 415/119 |

*Primary Examiner*—Edward K. Look
*Assistant Examiner*—Matthew T. Shanley
*Attorney, Agent, or Firm*—Raymond L. Coppiellie

[57] ABSTRACT

There is disclosed a housing for a centrifugal fan or blower or the like. The housing includes a wedge member for reducing the tonal noise generated during operation of the fan or blower. The wedge member is disposed on an interior surface of the housing chamber.

12 Claims, 3 Drawing Sheets

HOUSING FOR A CENTRIFUGAL BLOWER

BACKGROUND OF THE INVENTION

1. Field of the Invention

The present invention relates generally to a housing for a centrifugal fan, blower or the like. More particularly, the present invention relates to a volute housing for a centrifugal fan, blower or the like which reduces noise generated during operation.

2. Disclosure Information

Centrifugal fans or blowers are commonly used in the automotive, air handling and ventilation industries for directing a forced flow of air through a variety of air conditioning components. In a typical centrifugal blower, air is drawn into a housing through an aperture by a rotating blower or fan. This air is then forced around the housing and out an air exit end. In some situations, an undesirable whistling or other tonal noise may be generated by this flow of air. (As used herein, tonal noise means noise at frequencies equal to (nBN/60) where n equals 1, 2, 3, . . . , B equals the number of blades on the fan wheel and N is the rotational speed per minute of the fan wheel.) This noise is primarily due to a pressure pulse generated when fan blades pass the blower cut-off region, the necked down portion immediately adjacent the exit end of the blower housing. Various modifications to the housing have been proposed for reducing this noise.

The most common method for reducing this noise has been to modify the shape of the cut-off region of the blower. This has been done by inclining or altering the sides of the housing in this region, to effectively reduce the sudden increase in pressure (pulse shape) when rotating blades pass the cut-off region. More gradual cut-off inclinations are required for tonal noise reductions but these may affect airflow performance and manufacturability of the housing and its assembly.

Therefore, it would be desirable to reduce the tonal noise generated by a centrifugal blower without affecting its performance. It is an object of the present invention to reduce tonal noise in an economical manner without affecting the performance of the blower.

SUMMARY OF THE INVENTION

The present invention overcomes the problems of prior art blower designs by providing a volute housing for a centrifugal fan, blower or the like, comprising a pair of housing parts joined to each other along opposing peripheral edges at a radial plane, each of the housing parts including a sidewall. The housing further includes a generally circular fluid inlet opening disposed through either of the sidewalls, the generally circular fluid opening having a coincident axis. The housing also includes a volute peripheral wall disposed between the sidewalls and defining an interior surface, an exterior surface and a volute chamber and terminating in a fluid exit end. A wedge member is secured to the interior surface of the volute peripheral wall proximate the fluid exit end of the blower wheel and extending radially inwardly toward the coincident axis by a predetermined distance. In one embodiment, the wedge member includes an elongated, generally solid, rectangular member disposed on the interior surface of the volute peripheral wall at a predetermined location. The wedge member extends from the exit end of the housing approximately one-half the radial circumference of the volute peripheral wall.

The present invention provides the advantage of reducing tonal noise without degrading performance in a very manufacturable and economic manner.

These and other features, objects, and advantages of the present invention will become apparent from the drawings, detailed description and claims which follow.

BRIEF DESCRIPTION OF THE PRESENT INVENTION

DETAILED DESCRIPTION OF THE PREFERRED EMBODIMENTS

Figure 1:
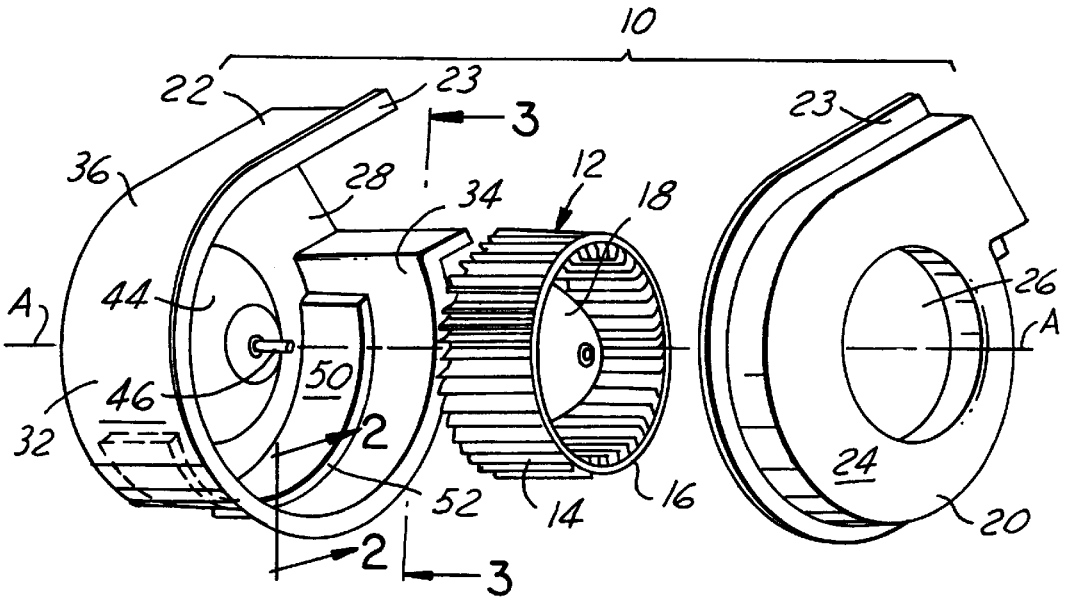
FIG. 1 is an exploded perspective view of a centrifugal fan or blower structured in accord with the present invention.
Figure 2:
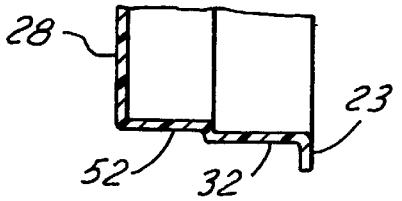
FIG. 2 is a cross-sectional view taken along line 2—2 of FIG. 1.
Figure 3:
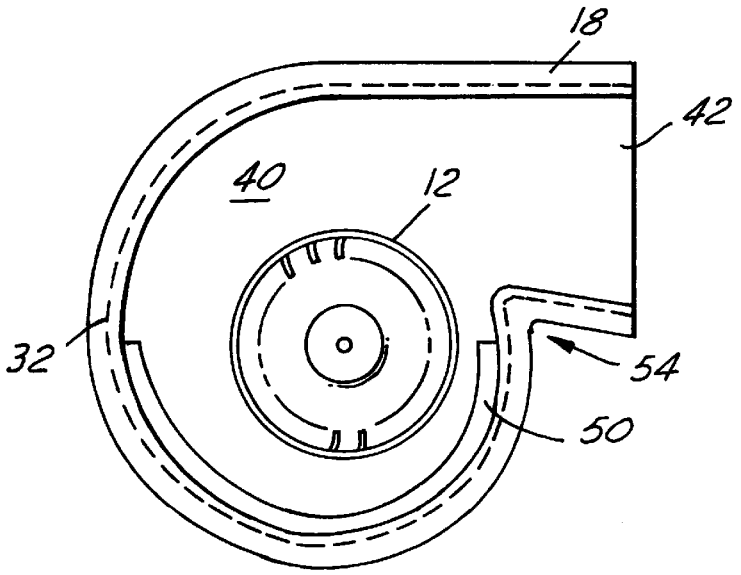
FIG. 3 is a cross-sectional view taken along line 3—3 of FIG. 1.

Referring now to the drawings, FIGS. 1–3 show a centrifugal blower/fan assembly according to the present invention. The centrifugal blower assembly 10 includes a fan wheel 12 having a plurality of fan blades 14 disposed around an inlet ring 16 and a hub 18 of the fan wheel. The fan wheel 12 is disposed within a housing 18 defined by two housing parts, an inlet housing cover 20 and an exit housing cover 22 which are joined together at a peripheral lip 23 extending around the circumference of each. The inlet housing cover 20 includes a sidewall 24 having an inlet aperture 26 through which a volume of air is drawn by the fan wheel 12 to provide a volume of air through different heating, ventilation, and air conditioning components found within a plenum of an automotive vehicle. The exit housing cover 22 also includes a sidewall 28 which may include an aperture (not shown) through which a fan motor may be placed for cooperating engagement with the fan wheel 12. A volute peripheral wall 32 having an interior surface 34 and an exterior surface 36 is disposed between the sidewalls 24, 28. The volute peripheral wall 32 and the sidewalls 24, 28 define volute chamber 40 and an exit end 42 through which the air passes into or toward the heating, ventilation, and air conditioning components in the plenum. The centrifugal blower assembly further includes a motor 44 having a shaft 46 which engages the centrifugal fan 12 to cause the fan to spin, thus drawing air in through the inlet end of the housing around the volute chamber 40 and through the exit or outlet end 42 of the centrifugal blower assembly 10. The motor shaft 46 defines an axis A—A coincident with the axis of rotation of the fan wheel.

The blower housing 18 includes a wedge member 50 secured to the interior surface 34 of the volute peripheral wall 32. The wedge member 50 may take many shapes as will be described herein. The wedge member 50 reduces the tonal noise generated by the fan wheel blades passing through the cut-off region and wedge member (the resultant noise is lower and is the sum of the noises due to the pressure pulse near the cut-off region and a pulse from the wedge member region). It is believed that these two pressure pulses cooperate to balance out the tonal noise generated within a blower. Analytical data have been generated showing reduced tonal noise when a wedge member such as described herein is utilized.

As shown in FIGS. 1–3, the wedge member 50 is shaped as a stepped wall member 52 which extends from immediately adjacent the cut-off region 54 of the blower to approximately half the radial circumference of the blower. The stepped wall member 52 extends radially inwardly approximately one-quarter to one-half inches toward the coincident axis of the blower motor. In a preferred embodiment, the wall 52 extends approximately one-third the radial circumference of the blower housing 18. Preferably, the stepped wall 52 is molded integrally with the housing part 22 while that part is being fabricated. Alternatively, the wall 52 can be secured mechanically to the interior surface with such known fastening techniques as gluing or screwing. As shown in FIG. 1, the wall extends from the sidewall 28 approximately halfway to the peripheral lip 23 of the exit housing cover 22.

Figure 4:
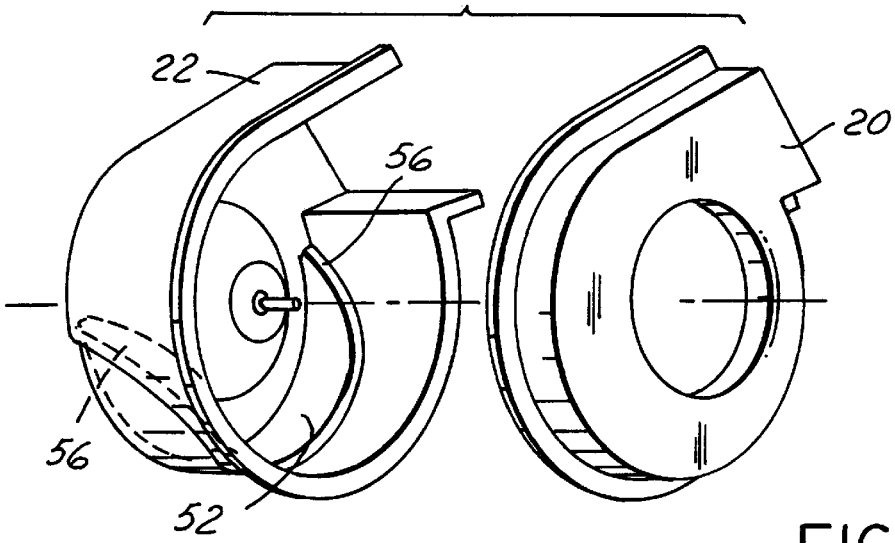
FIG. 4 is an exploded perspective view of an alternative embodiment of a centrifugal fan or blower structured in accord with the present invention.
Figure 5:
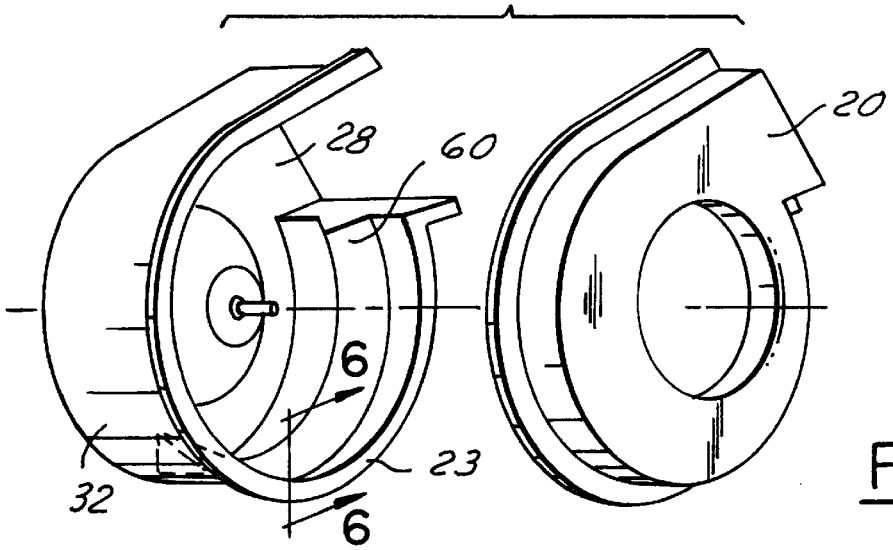
FIG. 5 is an exploded perspective view of an alternative embodiment of a centrifugal fan or blower structured in accord with the present invention.
Figure 6:
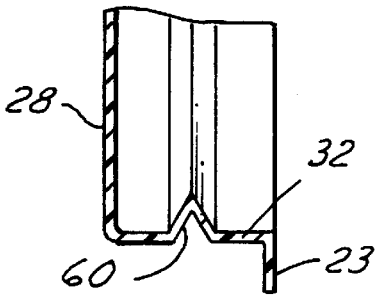
FIG. 6 is a cross-sectional view taken along line 6—6 of FIG. 5.

FIGS. 4–8 show alternative embodiments of the wedge member 50 used in centrifugal fan or blower housings. Like components will be given like reference numerals for ease of understanding. In FIG. 4, a stepped wall-shaped wedge member 52 is shown as having inclined or ramped ends 56 in place of the straight ends shown in FIG. 1. FIGS. 5 and 6 show a wedge member having the shape of an elongated member 60. The wedge 60 also extends approximately one-third the circumferential distance around the blower housing.

Figure 7:
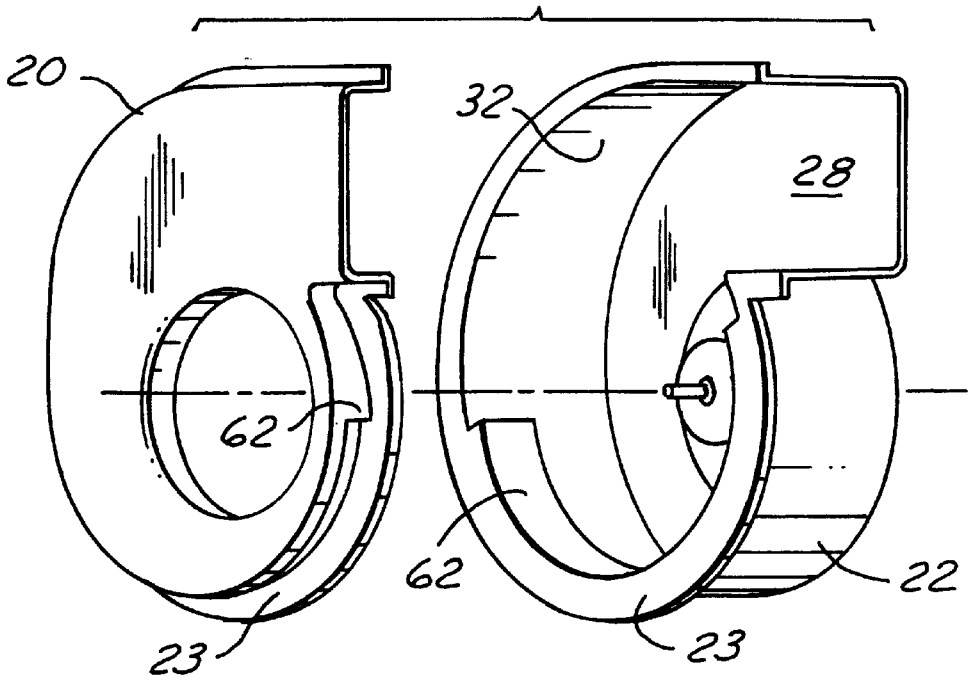
FIG. 7 is an exploded perspective view of an alternative embodiment of a centrifugal fan or blower structured in accord with the present invention.
Figure 8:
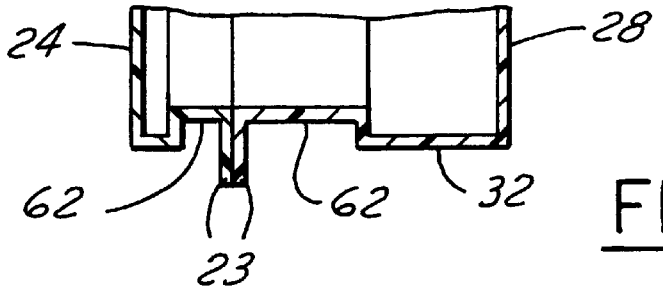
FIG. 8 is a cross-sectional view taken along line 8—8 of FIG. 7.

FIGS. 7 and 8 show yet another alternative of the present invention. In FIGS. 7 and 8, the wedge member 62 is formed on both parts of the housing 20 and 22. The wedge member 62 is formed proximate the peripheral lips 23 of each housing part such that when the parts are secured together, the halves of the wedge member 62 are in contact with each other so as to form a one piece member.

Optimization of the shape and placement of the wedge member 50 will be dependent on many factors, including size of the housing, the volume of air passing through the housing, the speed of the fan wheel as well as blade configuration and cut-off geometry. The above-described wedge members are shown as illustrative embodiments. Many other alterations will no doubt occur to those skilled in this art. It is the following claims, including all equivalents, which define the scope of my invention.

What is claimed is:

1. A volute housing for a centrifugal blower assembly, comprising:

a volute peripheral wall including a pair of opposed sidewalls and defining an interior surface, an exterior surface and a volute chamber and terminating in a fluid exit end;

a generally circular fluid inlet opening disposed through either of said sidewalls, said generally circular fluid opening having a coincident axis; and a wedge member secured to said interior surface of said volute peripheral wall proximate said fluid exit end and extending radially inwardly toward said coincident axis by a predetermined distance, said wedge member comprising a stepped surface with inclined ends extending about one-half the distance between said sidewalls on said interior surface of said volute peripheral wall.

2. A volute housing as claimed in claim 1, wherein said wedge member comprises an elongated, generally solid member disposed on said interior surface of said volute peripheral wall at a predetermined location.

3. A volute housing as claimed in claim 1, wherein said wedge member extends from said exit end of said housing approximately one-half the radial circumference of said volute peripheral wall.

4. A volute housing as claimed in claim 1, wherein said wedge member extends from said exit end of said housing approximately one-third the radial circumference of said volute peripheral wall.

5. A volute housing as claimed in claim 1, wherein said wedge member is secured to either of said pair of housing parts.

6. A volute housing as claimed in claim 5, wherein said wedge member is formed integrally on either of said pair of housing parts.

7. A volute housing for a centrifugal blower assembly, comprising:

a pair of housing parts joined to each other along opposing peripheral edges at a radial plane, each of said housing parts including a sidewall;

a generally circular fluid inlet opening disposed through either of said sidewalls, said generally circular fluid opening having a coincident axis;

a volute peripheral wall disposed between said sidewalls and defining an interior surface, an exterior surface and a volute chamber and terminating in a fluid exit end; and a wedge member secured to said interior surface of said volute peripheral wall proximate said fluid exit end and extending radially inwardly toward said coincident axis by a predetermined distance, said wedge member comprising an elongated, generally solid, rectangular member extending from said exit end of said housing approximately one-third the radial circumference of said volute peripheral wall, said wedge member being secured to either of said pair of housing parts.

8. A volute housing as claimed in claim 7, wherein said wedge member is formed integrally on either of said pair of housing parts.

9. A volute housing for a centrifugal blower assembly, comprising:

a pair of housing parts joined to each other along opposing peripheral edges at a radial plane, each of said housing parts including a sidewall;

a generally circular fluid inlet opening disposed through either of said sidewalls, said generally circular fluid opening having a coincident axis;

a volute peripheral wall disposed between said sidewalls and defining an interior surface, an exterior surface and a volute chamber and terminating in a fluid exit end; and a wedge member secured to said interior surface of said volute peripheral wall proximate said fluid exit end and extending radially inwardly toward said coincident axis by a predetermined distance, said wedge member comprising a stepped surface with inclined terminal ends extending about one-half the distance between said housing sidewalls on said interior surface of said volute peripheral wall.

10. A volute housing as claimed in claim 9, wherein said wedge member is secured to either of said pair of housing parts.

11. A volute housing as claimed in claim 10, wherein said wedge member is formed integrally on either of said pair of housing parts.

12. A volute housing as claimed in claim 10, wherein said wedge member comprises a first wedge member and a second wedge member, one of said first and second wedge members being formed integrally with each of said pair of housing parts proximate said opposing peripheral edges such that said first wedge member on one housing part engages the second wedge member on the other housing part.

* * * * *